US005846064A

United States Patent [19]

Refson

[11] Patent Number: 5,846,064

[45] Date of Patent: Dec. 8, 1998

[54] PERISTALTIC PUMP

[75] Inventor: Bernard Henry Refson, Penryn, United Kingdom

[73] Assignee: Metameric Limited, Penryn, United Kingdom

[21] Appl. No.: 793,819

[22] PCT Filed: Sep. 1, 1995

[86] PCT No.: PCT/GB95/02066

§ 371 Date: Mar. 6, 1997

§ 102(e) Date: Mar. 6, 1997

[87] PCT Pub. No.: WO96/07827

PCT Pub. Date: Mar. 14, 1996

[30] Foreign Application Priority Data

Sep. 6, 1994 [GB] United Kingdom ..... 9417920

[51] Int. Cl.[6] ..... F04B 43/12

[52] U.S. Cl. ..... 417/474

[58] Field of Search ..... 417/474, 477.1, 417/477.4, 477.6; 418/45, 153

[56] References Cited

U.S. PATENT DOCUMENTS

| | | | |
|---|---|---|---|
| 2,695,694 | 11/1954 | Seinfeld | 418/153 |
| 3,233,553 | 2/1966 | Chanton | 417/474 |
| 3,279,388 | 10/1966 | Roudaut | 418/153 |
| 3,433,171 | 3/1969 | Corneil | 417/474 |

FOREIGN PATENT DOCUMENTS

| | | | |
|---|---|---|---|
| 637586 | 6/1939 | Germany | 417/474 |

*Primary Examiner*—John J. Vrablik

*Attorney, Agent, or Firm*—Larson & Taylor

[57] ABSTRACT

A peristaltic pump, which provides a relatively rigid tubular body (2); a contained substantially tubular elastic element (1), with an outside diameter less than the inside diameter of the body and statically sealed to the ends of the body (2), and a mechanism which may consist wholly of rigid members for intermittently expanding the entire periphery of radial sections of the element up to the whole of the inside diameter of the body in axial sequence between two ports (4) therein. A torus-like pumping chamber (3), fully sealed in all three dimensions, is thus created, which, in operation, progresses axially between the ports, transporting fluid trapped within it from one to the other.

13 Claims, 3 Drawing Sheets

PERISTALTIC PUMP

TECHNICAL FIELD

This invention relates to peristaltic pumps and constitutes an improvement in their design and consequent performance capabilities.

BACKGROUND ART

Peristaltic pumps move fluids (liquids, suspensions and gases) by the axially progressive radial deformation of an elastic duct or element, of enclosed cross-section, usually in the form of annular tube, having as essential measurements a bore-size and a wall thickness.

Hitherto, the radial deformation has taken the form of a localised compression of the element, flattening it so that one flattened section of the wall is brought into fluid-tight contact with the radially opposite section of the wall. The compression may be effected by one or more rollers, sliding shoes or oscillating fingers, but the operation is identical: the sealed section is progressed a certain distance along the axial dimension, by suitable movement or succession of the operating members.

This pushes the contents ahead of the compressed section along the element and the restitution of the elastic material behind the compression draws in more fluid to be expelled in turn by a succeeding compression.

This arrangement has at least four drawbacks, which limit the range of performance of such pumps in terms of volume, pressure and duration.

A. It is a general characteristic of elastomers which forms the elastic duct or element, that the destructive effect of rapidly and frequently applied stresses and strains, necessary to the operation of a peristaltic pump, varies directly with their thickness and/or hardness. The requirement in the standard form of peristaltic pump that the elastic element should restitute from a flattened condition, against the force of atmospheric pressure, implies that the wall of the element be substantial in thickness or hardness and that either must increase directly with the bore-size of the element. Thus increasing flow-rate requirements, needing larger bores, lead inevitably to thicker and/or harder walls and shorter operating life.

B. In a standard arrangement, the regions of the wall of the element at the radial extremes of the compression, where the walls are being folded sharply, are subjected to very large concentrations of stresses and strains to ensure that the seal formed by the compression is complete across the whole width. This further promotes the breakdown of the elastomer at these particular locations.

C. As the elastic element of a standard peristaltic pump experiences the pumping pressure on its inside, increasing pressure requirements necessitate either yet thicker (or harder) walls, or external reinforcements that militate against the operation.

D. A further drawback of a standard design is that the radial load on the drive-shaft is unbalanced over at least a part of the shaft's revolution, making heavy demands on the bearings of rotating parts and their supporting structures.

DE 3833833 discloses a peristaltic pump which overcomes some of these problems by providing an inner flexible membrane within a rigid outer body. The mechanism for expanding the membrane uses a cam which acts an ball bearings which in turn push out rings thus expanding the flexible membrane.

The mechanism for expanding the inner membrane is complex, requiring many elements and detailed assembly.

This creates a peristaltic pump which is complicated and expensive to both assemble and repair if necessary.

Therefore, there is a need for a peristaltic pump that avoids or reduces some or all these problems and limitations.

DISCLOSURE OF INVENTION

Broadly, the present invention provides a peristaltic pump which employs an elastic-walled pumping element of enclosed cross-section and means of causing radial deformations in it progressively along its axis. It is therefore a true peristaltic pump and shares with the standard design the advantages that the operating mechanism is isolated from the fluid being pumped by the wall of the element, and that it has neither glands nor valves.

By the present invention there is provided a peristaltic pump having a tubular elastic member sealed to and inside a larger sectioned more rigid outer body and an actuating means, housed within the elastic member wherein the actuating means comprises a drive shaft and actuating members and wherein the drive shaft acts through a cam arrangement on said actuating members for intermittently and sequentially expanding cross-sections of the elastic member against corresponding sections of the inside of the outer body so as to form a travelling fluid-tight seal, characterised in that the actuating members at each longitudinal position in the axial direction, comprises a plurality of rigid elements extending around the interior surface of the elastic member and moved radially in unison by the cam arrangement.

The elements may be substantially laminar segments of a circle the outer diameter of which is substantially equal to that of the bore of the outer body less the wallthickness of the element.

These elements may be arranged in sets, each set being in a single radial plane so that the sum of their major arcs form a complete circle in their expanded state.

It is preferable that the major arc length of each element of the set subtends an angle greater than that obtained by dividing the circle by the number of elements in an actuating member. It is also preferable that the ends of the elements are reduced in thickness so as to allow overlap of adjacent elements in an actuating member without substantial increase in the total thickness of the actuating member.

A plurality of actuating members may be mounted face-to-face inside the elastic member so as to correspond in combined thickness approximately to the axial length of the pumping section between the inlet and outlet ports of the body.

The drive shaft may revolve concentrically to the actuating members and act on a chord of the elements at some stage of its revolution, but not, or less so, at another via a cam arrangement. The cam arrangement may comprise a plurality of protrusions, each protrusion engaging a separate chord of an element of an actuating member.

The chords of the elements of the actuating members are progressively offset in relation to the said drive shaft protrusions.

The cam arrangement protrusions may be rollers mounted at a suitable radial distance from the drive shaft and preferably are parallel to the drive shaft and pump axis.

In one embodiment the elements of the actuating members may be provided with integral protrusions on one face and mating slots in the other face centred at an angular displacement from that of the element protrusions; dimensioned and orientated to permit the elements to move radially but not rotationally in relation to those of neighbouring actuating members.

The two extremities of the pump outer body may be occupied by rigid, roughly cylindrical support members. These support members may also be provided with interior faces carrying similarly dimensioned and orientated protrusions and slots to those on the elements and may engage with those actuating members at the end of the actuating member assembly.

This will prevent rotation at the extremities of assembly, i.e. the support members are held non-rotationally to the outer body and elastic member of the pump in final assembly.

The support members may be fixedly conjoined to, or made in one piece with, an end-cap which may locate the drive shaft and also provide the means for sealing the end of the elastic member against the end of the outer body. Alternatively one support member may conjoin with an end-cap as described but the other may be housed within the closed end of the elastic member, providing support only as no other sealing or location is required.

In a second embodiment of the present invention the chords of the elements in each actuating member are parallel to those of other actuating members, i.e. in line, and the cam arrangement protrusions are formed from the vertices of a polygonally cross-sectioned region of the drive shaft, twisted to form a helix.

Accordingly, as the drive shaft rotates the protrusions of the cam arrangement act on the chords of the elements of each actuating member. Each protrusion acts on a separate element. Where four elements make up an actuating member, four protrusions act on the four chords forcing the elements to move radially away from the concentrically placed drive shaft. As the elements are forced outwards, the circumference of the actuating member increases thereby expanding the elastic member radially.

Both the first and second embodiments have the advantage that the configuration of the actuating members always makes a smooth continuous curve in either the expanded state or the relax state, so that no projections, which might damage the elastic member or any recesses, which may pinch the elastic member are formed.

The two embodiments of the present invention described above are based on a peristaltic pump having a circular cross-section. However, also within the scope of the present invention is a pump in which the cross-section of the body is non-circular and corresponding changes are made to the outlines of the elastic member and actuating and support members to maintain complete peripheral sealing against the said cross-section of the body by an actuating member of elements in the expanded mode.

BRIEF DESCRIPTION OF THE DRAWINGS

The invention will now be described, by way of example only, with reference to the accompanying illustrative drawings in which:

FIG. 3A and FIG 4 show subsequent transverse sections of a peristaltic pump at a single time interval showing a helical form of the cam protrusions in accordance with the second embodiment of the present invention;

BEST MODE FOR CARRYING OUT THE INVENTION

The elastic member 1, which may be of any enclosed cross-section, but may conveniently be annular, is housed concentrically within a relatively rigid member, or body 2, which has a similar, though internally larger cross-section. The ends of the elastic member 1 are statically sealed with respect to the space within the outer body 2, forming a fluid-tight region between the outer surface of the elastic member 1 and the inner surface of the outer body 2. This region 3 becomes the fluid conduit in operation.

There are two general ways in which the sealing of the ends of the elastic member may be effected. They are topologically similar, but as they give rise to differing constructions, they are described separately herein as FIG. 1 and FIG. 2 where appropriate.

Figure 1:
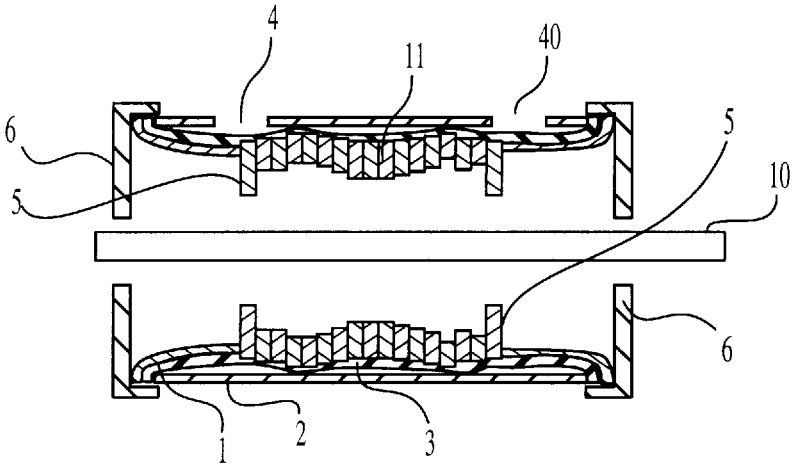
FIG. 1 a schematic drawing of a peristaltic pump being within a first embodiment of the present invention.

In FIG. 1 the wall at each end of the roughly cylindrical elastic member 1 is sealed to the corresponding end of the outer body wall 2, by compression, adhesion or fusion. The wall of the outer body 2 is pierced by at least two holes 4,40 one being near one open end of the body and the other being near the other end. These connect the otherwise enclosed space between elastic member 1 and outer body 2 with the outside world and with suitable connections form the inlet 4 and outlet ports 40 of the pump. The axial region between these holes is designated the pumping section (FIG. 1).

Figure 2:
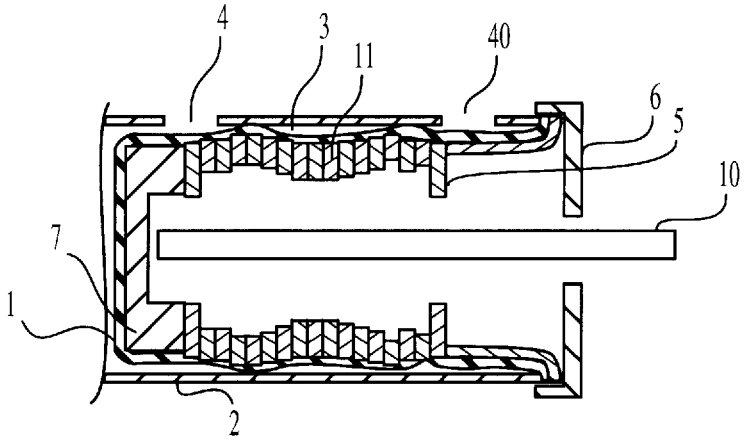
FIG. 2 a schematic drawing of a peristaltic pump being within a second embodiment of the present invention.

In FIG. 2 the wall at one end of the elastic member 1 is sealed to that of the outer body 2 as just described and that at the other end is closed in on itself, again by adhesion, compression or fusion, but preferably by being so moulded, so that the elastic member 1 takes on the form commonly described as 'test-tube' or 'top-hat'. In this type, as shown in FIG. 2, the outer body 2 may have two port piercings 4,40, as in FIG. 1 and have its end corresponding to the enclosed end of the elastic member 1 blanked off, or it may have only one side piercing for one port and the other port formed from the other, open, end of the outer body 2. The pumping section lies between the two side ports, or between the side port and the closed end of the elastic member 1, as appropriate (FIG. 2).

In both FIG. 1 and FIG. 2 those sections of the elastic member 1 which, in assembly lie at either side of the pumping section, are supported internally by rigid, approximately cylindrical support members 5,7 of an external diameter similar to that of the inside of the elastic member 1 in its relaxed state. These support members 5 are partially closed at their inward ends with a face that is pierced to allow the passage of a drive-shaft 10 and attachment (FIGS. 1 and 2).

In FIG. 1 both of the above support members 5 are fixedly conjoined to, or made in one piece with, an end-cap 6 which may locate the drive-shaft 10 and also provide the means for sealing the end of the elastic member 1 against the end of the pump outer body 2 by wedging the exterior of the first against the interior of the second, or by pressing the turned-over end of the elastic member 1 against the rims of the outer body 2, or, if the elastic member 1 is so moulded or fabricated, by compressing a flange integral to the end of the elastic member 1 against a mating flange formed on the end of the pump outer body 2, or any combination of these.

In FIG. 2 one of the said support members 5, conjoins with an end-cap as above described, but the other support member 7 is housed within the closed end of the elastic member 1, providing support only; no other sealing or location being required. In the case of this particular support member 7, its outer end is closed off by a face which will conform to the shape of the closed end of the elastic member 1.

The supporters alone, or the support/end-cap 5,7 assemblies may house bearings for the drive-shaft 10, although, as will be seen, these are not strictly necessary.

In both figures, actuating means are provided for sequentially expanding the entire periphery of relatively thin sections of the elastic member 1 against the inner surface of the outer body 2 along the said pumping section. These actuating means may be hydraulic or pneumatic, as in the rapid inflation of annular elastic collars, or tyres, held on discs of a diameter similar to that of the element in its relaxed state. However, for simplicity of manufacture, a preferred mechanical form is now described, as it would apply to bodies and elements of annular cross-section.

Figure 5A:
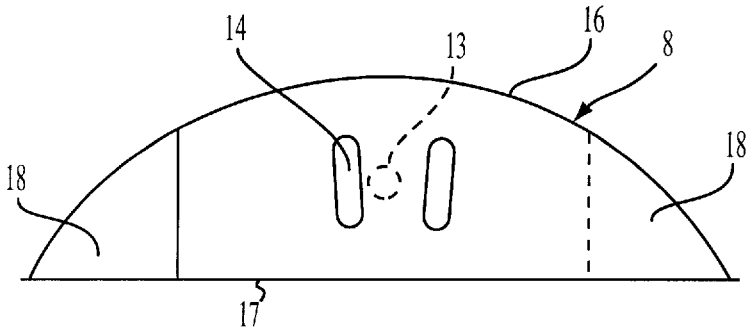
FIGS. 5*a* and 5*b* show an element, in plan and profile, respectively, which makes up the actuating members of the peristaltic pump according to the present invention.

In both FIG. 1 and FIG. 2 peristaltic pumps, the annular length inside the elastic member 1 between the support members 5, and corresponding to the pumping section of the outer body 2, is occupied by a series of rigid elements 8. These are substantially laminar, with a profile similar to that of a segment of the circle whose radius is approximately that of the inside surface of the outer body 2, less the wall-thickness of the elastic member 1. That is to say that one edge or arc 16 is a curve mainly of that radius and the other edge, joining the ends of this curve, approximates to the chord 17 of the element (FIGS. 5*a–b*).

Figure 3:
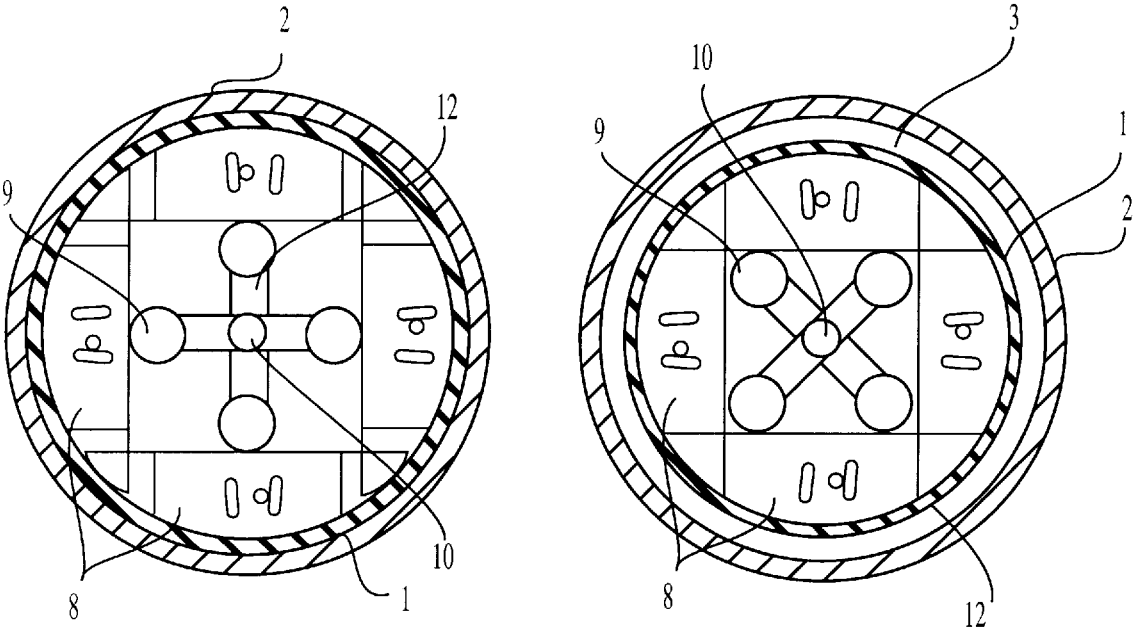
FIG. 3 and FIG. 4 shows a transverse section of a peristaltic pump at distinct time intervals thus showing an expanded and relaxed state in accordance with the first embodiment of the present invention.
Figure 3A:
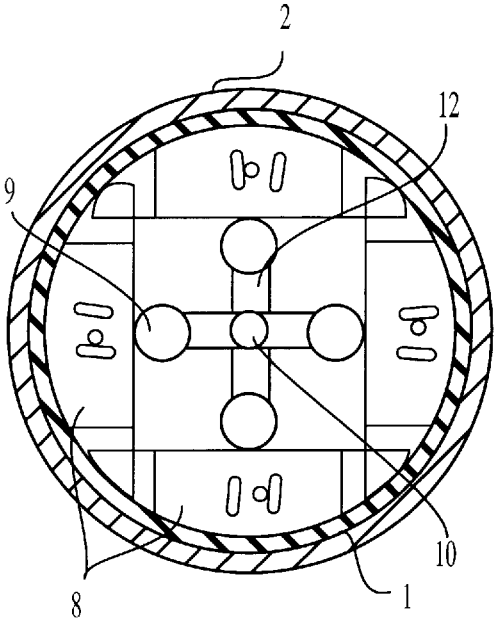
Figure 4:
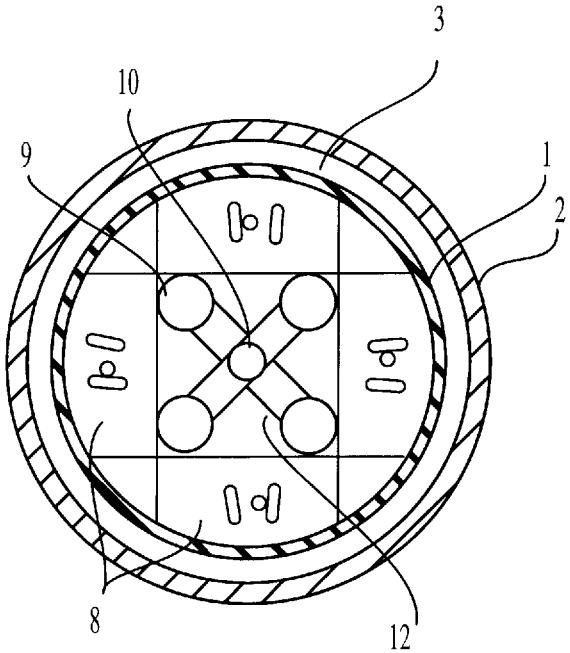

A plurality of such laminar segment-like elements 8 forms a circular actuating member 11, disposed in a single radial plane normal to the pump and drive shaft axis. These actuating members are shown in FIGS. 1 and 2 as hollow structures for convenience. They are however, solid structures as shown in FIG. 5. The number of rigid elements in a set in the actuating member 11 may be any number into which the circle of the above described radius may be divided, although the number 2 would require a non-annular cross-section. FIGS. 3 and 4 show a four-member set.

Figure 5B:
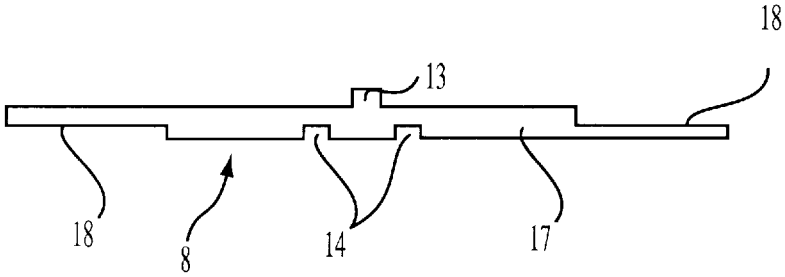
Figure 6:
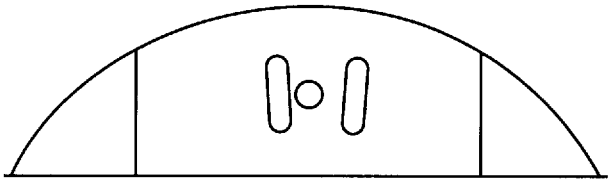
FIG. 6 shows curve centres and slot orientation of the elements of a peristaltic pump according to the present invention.

Each element 8 of the actuating member 11 is of an arc 16, and hence chord 17, longer than that which would exactly divide the said circle by the number in the set and portions 18 at the ends of each element 8 are reduced in thickness so that adjacent elements may overlap to a limited extent without increasing the overall thickness (FIG. 5*b*). Those parts of the curve outside the angle dividing the circle by the number of elements 8 in the actuating member 11 may be at a different radius and/or from a different centre to those of the main arc. These parts of the curve join the main arc and engage those of adjacent elements 8 smoothly in the overlapped state. This eliminates projections in the relaxed state which might damage the elastic member 1. As an example, in a four-element actuating member, those parts of the curved edge outside of 45° to each side of the perpendicular bisector may be of the same radius C as the main arc, but at centres displaced from the centre of the main arc by a distance, X, to the opposite side of the perpendicular bisector and the same distance from the original centre towards the element. 'X' approximates to the radial movement of the element 8 as described below (FIG. 6).

The straighter edges or chords 17 of the elements 8 are engaged by protrusions 9 being a cam arrangement, from the drive shaft 10, passing through the common axis of the elastic member 1 and the pump outer body 2, which act as cams as the shaft rotates. The number of protrusions 9 will normally correspond with the number of elements 8 in an actuating member 11, and be evenly distributed around the drive shaft 10, so that all elements 8 of the actuating member 11 are actuated in a like manner at the same time. The action is to push the elements 8 radially outwards to the full diameter of the segments, thus stretching and pressing the elastic member 1, in that plane, against the inner wall of the pump outer body 2, evenly and over its entire circumference. A fluid-tight seal is thus formed at a point along the pumping section of the body, separating the annular space on one side of it from that on the other (FIGS. 3 and 4).

A plurality of such actuating members 11 occupies the length of the pumping section with only sliding play between them. At the points of drive shaft 10 rotation where they are not fully engaged by the cam protrusions 9, they are drawn inwards by the restitution or elasticity of the elastic member 1. As they move inwards, adjacent elements 8 will increasingly overlap. At the inward limit of their travel, determined by the extent of the portions 18 of reduced thickness, the elements 8 of each actuating member 11 lock together to a rigid structure. The extent of the overlapping thinned portions 18 is selected to lock the elements 8 of the set when they are at an effective diameter substantially the same as that of the support members 5. This ensures complete internal support of the elastic member 1, throughout its length, and at all stages of the pumping cycle, since the elements are supported by the said drive shaft 10 cam arrangement protrusions 9 at all other stages.

In order to generate a pumping action, the seal formed by one actuating member 11 of elements 8 in the expanded position, is progressed along the pumping section by sequentially expanding and relaxing adjacent actuating members 11. This is achieved by progressively skewing or offsetting the orientation of each actuating member 11 of elements 8 in relation to the cam protrusions 9 of the drive shaft 10.

There are two ways in which this may be effected. One is to skew successive sections of the cam protrusions 9 on the drive shaft 10, whilst the orientation of the actuating members 11 of elements is kept constant. An example of this would be, in a four-element actuating member design, incorporating a square-sectioned region of the drive shaft 10 corresponding to the pumping section of the outer body 2 and giving this section a twist so that the vertices of the square (the protrusions 9) take a helical form (as shown by FIGS. 3 and 4).

This helix will then engage and release successive actuating members 11 of elements 8 at successive stages or the drive shaft's 10 revolution.

The other is to skew the orientation of each actuating member 11 of elements 8 in relation to that of the previous actuating member 11, whilst keeping the line of the protrusions 9 parallel with the axis of the drive shaft 10 (as shown by FIGS. 3' and 4'). In this case, the protrusions 9 may be in the form of cylindrical rollers, pivoted on bearings parallel to the drive shaft 10 axis and held by flange or other suitable members 12 fixed to the drive shaft 10 at an appropriate and preferably adjustable radial distance from it. The length of the rollers is sufficient to ensure that they engage all the elements 8 of the actuating members in the pumping section.

A variety of mechanical means which would restrain the actuating members 11 from rotating about the drive shaft 10 axis, yet allow the requisite movement normal to that axis and maintain the relative skewing of the actuating members 11 will be in accordance with this invention. These may include cages with skewed peripheral slots into which the elements 8 are slidingly set; rods, passing through slots in the thickness of the elements 8 which are affixed to the face of one support member 5 and twisted before being affixed to that of the other.

The most elegant arrangement, however, in that it calls for no additional parts, provides each element with a protrusion 13 on one face, of a protruding length a little less than the thickness of the element and at least one slot or groove 14 at a suitable angular displacement from the said protrusion 13. When assembled, the protrusions 13 of one actuating member 11 of elements 8 engage slidingly in the slots or grooves 14 of the adjacent actuating member 11, providing both a fixed angular displacement of one actuating member 11 in relation to the next and means to allow the elements 8 of one actuating member 11 to move in the plane normal to the drive shaft 10 axis in relation to those on either side (FIGS. 5*a–b*). Matching protrusions 13 and slots 14 in the inner faces of the support members lock the entire assembly rotationally with respect to the pump outer body 2.

Rotation of the drive shaft 10, transmitted through the cam arrangement carrying the said rollers or other shaft protrusions 9, bring these into actuating contact with successive actuating members 11 of elements 8 and thus creates the required travelling wave of expansions of the elastic member 1 against the pumping section of the pump outer body 2. The number and relative alignment of the actuating members 11 of elements 8 are selected to provide that the peak of one such wave is established in the pumping section before that of a previous such peak has left it, thus ensuring continuous pumping.

More particularly, and by way of example, (FIG. 6), the element protrusion 13 is conveniently located on the perpendicular bisector of the element 8; the angular displacement of the centre of the slot, D, about the centre of the main actuator arc may be derived from the formula:

$$D = \frac{360}{WS}$$

where W=Number of Sets in a wavelength, between peaks and S=Number of actuator segments in a set and the orientation of the major axis of the slot or groove 14 with respect to the perpendicular bisector of the element 8 may be at angle M in the formula:

$$M = \frac{180}{WS}$$

The minimum length of the slot or groove 14 may be the sum of the diameter of the said element 8 protrusion 13 and the desired radial movement of the elements, X. This last is a function of the inverse of S and the effective radius of the drive shaft cam protrusions 9 (or rollers) as they first engage the elements 8. It will generally be selected to be in the region of one thirtieth of the pump outer body 2 bore.

Each element 8 may be provided with two or more slots or grooves 14, positioned, orientated and dimensioned to express the above formulae, or ones with a similar effect, with different values of 'W', 'S' and 'X'. All three values are in turn dependent upon the desired relationship between the flow-rate, pressure and duration capabilities for particular types of application, through their effect on the volume of fluid displaced by each expansion and relaxation cycle of an actuating member 11 of elements 8.

The pump cycle, that is the travel of a complete wavelength of set expansions, occurs S times per revolution of the drive shaft 10. The direction of the wave travel, and hence of the movement of the fluid being pumped is reversed by reversing the rotation of the drive shaft 10. The pumping section may accommodate two or more wavelengths, which may be the same or different in the number, thickness and dimensions of the actuating members 11, to meet specific pumping requirements.

The drawbacks of the standard design of externally operated peristaltic pump are avoided in the present design as follows:

A. The restitution of the elastic member 1 is by contraction of its entire stretched wall. The amount of elastomer involved is directly proportional to its diameter and hence design flow-rate of the pump, so the strain on any given amount or circumferential length of the elastomer is substantially the same for any size without need to change the wall-thickness.

B. In the peristaltic pump of the present invention, the stress and strain on the elastomer are spread evenly throughout the material of the elastic member 1 at any cross-section. There are thus no localised regions of stress and strain concentration to initiate failure.

C. The wall of the elastic member 1 experiences the pumping pressure on its outside surface and is firmly supported at all points and times against this pressure by the described rigid structures 5 and 11. It is thus not the limiting factor in the pump's pressure capability.

D. As the drive shaft 10 cam protrusions 9 are always in the same relationship with all the elements of each set of actuating members 11 radially opposite each other, the radial load on the drive-shaft 10 is substantially balanced at all points of revolution. This is why, although it is convenient to have shaft-bearings in the centre of the end-caps, these are not strictly necessary for operation and are only light loaded. As a consequence, the construction of this peristaltic pump for a given duty will typically be lighter and more economic than that of previous peristaltic pumps.

I claim:

1. A peristaltic pump comprising:

a rigid outer body which is tubular, said outer body having a longitudinal axis, an inlet and an outlet;

a tubular elastic member located in said outer body with a radial space provided between an inside of said outer body and said elastic member, said elastic member being sealed to said outer body by an inlet seal and an outlet seal provided such that said inlet and outlet of said outer body are longitudinally therebetween;

an actuating means housed within said elastic member for pumping a material along the space from said inlet to said outlet, said actuating means including a drive shaft, a series of actuating members located at a series of longitudinal positions along said elastic member between said inlet and said outlet, each said actuating member including a plurality of rigid elements extending around an interior surface of said elastic member, and a cam arrangement moved by said drive shaft which intermittently and sequentially moves radially in unison said rigid elements of said series of actuating members such that radial cross sections of said elastic member at each longitudinal position are intermittently and sequentially expanded against corresponding sections of the inside of said outer body to pump the material.

2. A peristaltic pump as claimed in claim 1:

wherein said outer body has a circular cross section; and wherein said rigid elements are segments of a circle, a diameter of the circle being about equal to a diameter of the inside of said outer body minus a wall thickness of said elastic member.

3. A peristaltic pump as claimed in claim 2:

wherein each said actuating member is a set of said rigid elements provided in a single plane, each said rigid element having a radially outer face formed as an arc such that all of said faces of the set form a complete circle when an associated said radial cross section of said elastic member is expanded against the corresponding section of the inside of said outer body.

4. A peristaltic pump as claimed in claim 3:

wherein a major arc length of each said rigid element has an angle greater than that obtained by dividing 360° by a number of rigid elements in each said set; and wherein each said rigid element has ends of reduced thickness which allow for an overlap with adjacent elements of said set.

5. A peristaltic pump as claimed in claim 1:

wherein a distance between said inlet and said outlet of said outer body defines an axial length of a pumping section of said outer body; and wherein said series of actuating members are arranged face to face along the longitudinal axis of said outer body with a combined thickness approximately equal to the axial length of the pumping section.

6. A peristaltic pump as claimed in claim 5, further including:

an inlet rigid support member provided inside of said elastic member and occupying a space between an inlet end of said series of actuating members and an inlet end of said outer body; and an outlet rigid support member provided inside of said elastic member and occupying a space between an outlet end of said series of actuating members and an outlet end of said outer body.

7. A peristaltic pump as claimed in claim 1:

wherein said cam arrangement includes a plurality of protrusions.

8. A peristaltic pump as claimed in claim 7:

wherein said drive shaft is concentrically positioned relative to said outer body; and wherein said segments of a circle making up said rigid elements include respective chord portions, each said chord portion being engaged by a respective said protrusion to expand the radial sections of said elastic member.

9. A peristaltic pump as claimed in claim 8:

wherein there is a respective skewing between successive said chord portions of said actuating members of the series and successive protrusions of said cam arrangement.

10. A peristaltic pump as claimed in claim 9:

wherein said protrusions are aligned in a series extending parallel to said drive shaft and successive chord portions are skewed with respect to one another.

11. A peristaltic pump as claimed in claim 9:

wherein said chord portions are parallel to one another and said protrusions are aligned in a helical series extending about said drive shaft.

12. A peristaltic pump as claimed in claim 1:

wherein each said rigid element includes an integral protrusion on one face and a mating slot in the other face centered at an angular displacement from said integral protrusion such that when said protrusion of one said rigid element is located in said mating slot of an adjacent said rigid element said one rigid element and said adjacent rigid element can move radially with respect to one another but not rotationally.

13. A peristaltic pump as claimed in claim 12:

further including (a) an inlet rigid support member provided inside of said elastic member and occupying a space between an inlet end of said series of actuating members and an inlet end of said outer body, and (b) an outlet rigid support member provided inside of said elastic member and occupying a space between an outlet end of said series of actuating members and an outlet end of said outer body; and wherein each said rigid support member includes an integral protrusion on one face and mating slots in the other face centered at an angular displacement from said integral protrusion thereof such that when said protrusion of one said rigid support member is located in said mating slot of an adjacent said rigid element and said mating slot of the other said rigid support member receives said protrusion of an adjacent said rigid element, adjacent said rigid support members and said rigid elements can move radially with respect to one another but not rotationally.

* * * * *